US005742564A

United States Patent [19]

Kuschel et al.

[11] Patent Number: 5,742,564

[45] Date of Patent: Apr. 21, 1998

[54] TIMEPIECE WITH SWITCH OPERABLE BY PRESSING THE TIMEPIECE GLASS

[75] Inventors: Pieter Kuschel, Schiltach; Andreas Müller, Sulzbach, both of Germany

[73] Assignee: Junghans Uhren GmbH, Schramberg, Germany

[21] Appl. No.: 753,431

[22] Filed: Nov. 25, 1996

[30] Foreign Application Priority Data

Nov. 29, 1995 [DE] Germany ..... 195 44 460.4

[51] Int. Cl.[6] ..... G04C 17/00; G04B 19/00

[52] U.S. Cl. ..... 368/69; 368/224; 368/296

[58] Field of Search ..... 368/69–70, 185–187, 368/223–225, 228, 294–296, 319–321

[56] References Cited

U.S. PATENT DOCUMENTS 4,064,688 12/1977 Sasaki et al. ..... 368/69
4,147,929 4/1979 Sasaki et al. ..... 368/69
4,247,115 1/1981 Hatuse et al. ..... 368/69
5,253,226 10/1993 Ganter .
5,453,960 9/1995 Teres et al. ..... 368/69
5,559,761 9/1996 Frenkel et al. ..... 368/69

FOREIGN PATENT DOCUMENTS

WO 84/02203 6/1984 WIPO .

*Primary Examiner*—Vit W. Miska
*Attorney, Agent, or Firm*—Burns, Doane, Swecker & Mathis, L.L.P.

[57] ABSTRACT

A timepiece, such as a wristwatch, includes a casing, a carrier disc disposed in the casing, a glass mounted elastically to the casing in front of the carrier disc, and control switches in the form of piezoelectric sensors each sandwiched between an outer edge of the glass and a forwardly facing edge of the carrier disc. The sensors are electrically connected to an electrical control circuit of the timepiece and are actuable in response to being compressed by a rearward pressure applied to the outer edge of the glass.

9 Claims, 1 Drawing Sheet

TIMEPIECE WITH SWITCH OPERABLE BY PRESSING THE TIMEPIECE GLASS

BACKGROUND OF THE INVENTION

The invention relates to a timepiece possessing an operating switch which is actuated by applying pressure to an edge of the timepiece glass.

A timepiece of that kind is known from Publication No. WO 84/02203. In that arrangement, there is provided beneath the edge of the timepiece glass an electromechanical switching section, for the actuation of which a wedge member has to be displaced parallel to the axis of the shafts of the timepiece hands. That displacement is effected by pressure being applied above the wedge member to the edge region of the timepiece glass which is fitted into the timepiece casing floatingly by means of a resilient mounting. This construction for the actuation of an electromechanical contact section however is electrically not particularly reliable and takes up a great deal of space both in the radial direction and also in the axial direction of the casing. In addition it is not possible to provide for a defined position of the timepiece glass in the casing because it must be made possible to press the edge of the timepiece glass inwardly to a relatively great extent in order to displace the wedge member sufficiently far for making electrical contact.

In consideration of those facts a technical object of the present invention is to develop a timepiece of the general kind set forth, in such a way that it can be more compact and in particular shallower in design and permits the timepiece glass to be mounted in the casing more reliably in regard to the requirements in respect of sealing integrity.

SUMMARY OF THE INVENTION

In accordance with the invention that object is essentially attained by a timepiece which comprises a casing, a carrier disc mounted in the casing, an electrical circuit disposed in the casing behind the carrier disc, and a glass mounted elastically to the casing in front of the carrier disc whereby an outer edge of the glass can be rearwardly depressed, and control switches comprising piezoelectric sensors each interposed between the outer edge of the glass and a forwardly facing edge of the carrier disc. The sensors are electrically coupled to the electric circuit and are actuable in response to being compressed by a rearward pressure applied to the outer edge of the glass.

In accordance with this construction with the pressure switch being in the form of a piezoelectric sensor arranged between the timepiece glass and the subjacent carrier disc (for the timepiece dial and works), practically travel-free actuation is achieved; instead of the timepiece glass being mounted in the casing in a soft-elastic fashion, the invention permits the timepiece glass to be mounted in the casing in a stiff-elastic, defined fashion. Arranging the piezoelectric sensor directly on the edge of the carrier disc affords simple ways of making electrical connection to an evaluation circuit which is eccentrically fixed on the rear side of the carrier disc.

In order not to have to profile the carrier disc for bridge functions of the timepiece works (as is known from European Patent 0 531 853 for the example of a ferrite works plate for a radio-controlled timepiece antenna coil), the works (in the case of a radio-controlled timepiece design including hands position detectors for example in the form of light barrier means) is contained in a separate works capsule which in turn is mounted completely behind the carrier disc. In order to provide a fully automatic, self-sufficiently operating timepiece, solar-electrical operation of the timepiece circuit and the motor for driving the works is provided by photoelectric cells whose silicon layer is disposed directly on a ceramic carrier disc (preferably comprising zirconium oxide or aluminum oxide), behind the timepiece glass. That provides a saving in terms of structural height relative to the conventional application of separately produced solar cells. A buffer storage means for the solar current is then arranged on the rear of the carrier disc, next to the works.

Within the timepiece casing, beside the storage means and the works capsule, there is a free space for receiving a tuned magnetic long wave antenna for the operation of a radio-controlled timepiece receiver. In the interest of maximizing the antenna length, the core thereof extends on both sides of an antenna coil in a curved configuration along a cylindrical surface of the casing.

The invention provides an extremely flat, fully automatic timepiece, without openings for operating elements, in which the solar cells are disposed directly on a ceramic carrier disc which carries in mutually opposite relationship the further mechanical and electrical components and the circuitry thereof and also carries pressure switches which operate practically in a travel-free manner and which are manually actuable along the edge of the timepiece glass.

BRIEF DESCRIPTION OF THE DRAWING

Additional alternatives and developments and further features and advantages of the invention are apparent from the detailed description of a preferred embodiment of the invention, which is diagrammatically illustrated in the drawing and is limited to what is essential, and substantially without being to scale. In the drawing.

DETAILED DESCRIPTION OF A PREFERRED EMBODIMENT OF THE INVENTION

Figure 1:
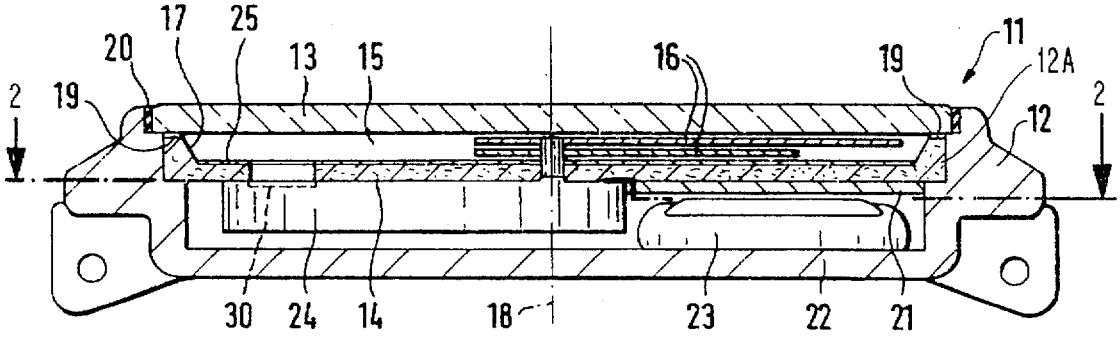
FIG. 1 is a view in axial section on a greatly enlarged scale of a wristwatch designed in accordance with the invention.

A wristwatch 11 is illustrated in the drawing as an example of a flat timepiece designed in accordance with the invention. The mounting configuration thereof is in the form of a flat or shallow cup-shaped casing 12 which at the forward viewing side is hermetically closed by a timepiece glass 13. Below or behind the timepiece glass 13 a carrier disc 14 is fitted into the casing 12 in sunk relationship therein, more specifically being force-lockingly fitted into a stepped reduction in the otherwise hollow-cylindrical inside peripheral surface 12A of the casing 12. A flange portion 17 of the carrier disc 14 extends around the casing 12 along the cylindrical inside surface 12A and serves to define an axially intermediate space 15 in which the hands 16 rotate. The flange portion 17 extends upwardly from the carrier disc 14 coaxially relative to the axis 18 of the shafts of the hands. Alternatively, the flange could be formed by a downwardly or rearwardly projecting portion of the glass. A flat or shallow piezoelectric sensor 19 is disposed at least at one location in the configuration of the flange portion 17, in front of the forwardly facing end face thereof. The piezoelectric sensor 19 serves as an actuating switch for operating the timepiece 11 and is manually actuated by axially pressing on the edge portion of the timepiece glass 13 disposed above, or in front of, the sensor 19. As the timepiece glass 13 is elastically fitted into the casing 12 by the interposition of a stiff rubber ring 20, the practically travel-free response on the part of the piezoelectric sensor 19 means that a minimum displacement of the edge of the timepiece glass 13 relative to the flange portion 17 which is rigidly fixed to the casing 12 is sufficient for actuation of the piezoelectric sensor 19. A plurality of sensors 19 (i.e., at least two, and preferably, three or four such piezoelectric sensors 19) are arranged in circumferentially mutually displaced relationship between the displaceable edge of the timepiece glass 13 and the fixed edge of the carrier disc 14, for performing different functions. The piezoelectric sensors 19 are connected to a multilayer circuit 21, e.g., for evaluation of the pressure-dependent discrete (binary) switching states, by way of laminated-on or integrated conductor tracks (not shown in the sectional view in the drawing).

The multilayer circuit 21 is mounted eccentrically directly beneath or behind the carrier disc 14, i.e., on the side of the carrier disc 14 which is remote from the timepiece glass 13. An electrophysical or electrochemical storage means 23 rests on the bottom or rear wall 22 of the casing 12. The storage means 23 serves for electrically powering the multilayer circuit 21 and a motor which is driven by the circuit 21 in a time-keeping mode for driving the hands mechanism. The motor is enclosed in a works capsule 24 which is mounted beneath the carrier disc 14, for example mechanically latched in position, eccentrically, beside the multilayer circuit 21, overlapping the position of the axis 18 of the shafts of the hands.

The surface of the carrier disc 14 which faces the timepiece glass 13 and which within the flange portion 17 is surrounded by the dial markings, is provided with solar-electric converters 25 (so-called solar cells) for recharging the storage means 23. So that the structure of the timepiece, which in any case is already compact, can be made even shallower, the solar cells do not involve discrete cells which are mounted on the carrier disc 14; but rather the carrier disc 14 comprises an electrically non-conducting and mechanically highly stable ceramic substance such as preferably zirconium or aluminum oxide which is directly provided on its rear face with connecting conductor tracks (traces) for both the motor disposed in the works capsule 24 and the multilayer circuit 21. The disc 14 is directly coated on its front side (visible side) with silicon for the solar cell function.

Figure 2:
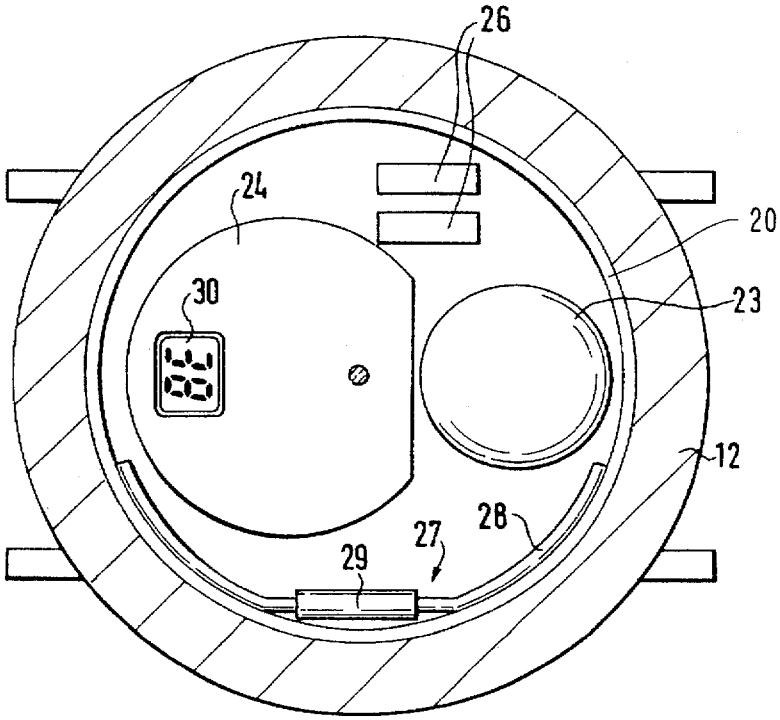
FIG. 2 is a cross-sectional view of the wristwatch taken along line 2—2 in FIG. 1.

So that the timepiece 11 is as user-friendly as possible in terms of its design, the multilayer circuit 21 desirably also includes a radio-controlled timepiece function with semiconductor chips, which are directly bonded in position, for a receiver, a demodulator and an evaluation processor for checking and correcting the hands positions in accordance with currently received time telegrams. A quartz oscillator 26 for operation of the tuned radio-controlled timepiece receiver and for operation of the processor, as well as a small tuned magnetic long wave antenna 27 are also disposed as discrete components in the casing 12 of the timepiece 11. A flexible core 28 of the antenna 27 fits snugly in an arcuate configuration along the hollow-cylindrical inside surface 12A of the casing 12 in the remaining space beside the works capsule 24 and the storage means 23 (see FIG. 2). In its middle region the core 28 carries an antenna coil 29 which is connected to the circuit 21 and which is thereby oriented tangentially in the casing 12, parallel to the timepiece glass 13 and the casing bottom 22. An electro-optical display element 30 is provided in the works capsule 24 below a window-like opening in the carrier disc 14.

What is claimed is:

1. A timepiece comprising:

a casing;

a carrier disc mounted in the casing;

an electrical circuit disposed in the casing behind the carrier disc, the circuit disposed eccentrically with respect to a center axis of the carrier disc;

a glass mounted elastically to the casing in front of the carrier disc whereby an outer edge of the glass can be rearwardly depressed; and control switches comprising piezoelectric sensors each interposed between the outer edge of the glass and a forwardly facing edge of the carrier disc, the sensors being electrically coupled to the electric circuit and being actuable in response to being compressed by a rearward pressure applied to the outer edge of the glass.

2. The timepiece according to claim 1, wherein one of the carrier disc and glass includes an annular flange extending coaxially with respect to the center axis; the sensors being sandwiched between the flange and the other of the carrier disc and glass.

3. The timepiece according to claim 1, wherein the circuit is a multilayer circuit.

4. The timepiece according to claim 1 further including timekeeping hands rotatable about the center axis, and a motor operably connected to the hands; the motor disposed within a works capsule disposed behind the carrier disc.

5. The timepiece according to claim 1 further including solar cells mounted on a front surface of the carrier disc.

6. The timepiece according to claim 5 further including an electrical energy storage member disposed adjacent to the works capsule behind the carrier disc.

7. The timepiece according to claim 1, wherein the carrier disc includes a window, the works capsule including an electro-optical display element disposed behind the window in alignment therewith.

8. The timepiece according to claim 1, wherein the casing includes a cylindrical inside surface, the timepiece further comprising timekeeping hands rotatable about the center axis, a motor operably connected to the hands and disposed within a works capsule disposed behind the carrier disc, an electrical energy storage member disposed adjacent to the works capsule behind the carrier disc, and a magnetic radio-controlled antenna comprising a coil and an arcuate core, the core extending along the cylindrical inside surface of the casing behind the carrier disc and being situated adjacent the works capsule and the storage member, the antenna being electrically connected to the circuit.

9. The timepiece according to claim 1, wherein the timepiece comprises a wristwatch.

* * * * *